United States Patent [19]

Thompson

[11] Patent Number: 4,625,888

[45] Date of Patent: Dec. 2, 1986

[54] GROUND ACTUATED LID OPERATING SYSTEM

[76] Inventor: Andy L. Thompson, R.R. 1, Courtland, Kans. 66939

[21] Appl. No.: 799,139

[22] Filed: Nov. 18, 1985

[51] Int. Cl.[4] ..... B65D 43/26

[52] U.S. Cl. ..... 220/262; 220/345; 220/263; 220/264; 49/362; 49/404

[58] Field of Search ..... 220/262, 320, 263, 264, 220/345, 346; 49/324, 347, 362, 404; 52/192, 66, 72

[56] References Cited

U.S. PATENT DOCUMENTS 3,733,764 5/1973 Hege ..... 220/262

4,267,936 5/1981 Pavlicek ..... 220/262

*Primary Examiner*—George T. Hall

*Attorney, Agent, or Firm*—Phillip A. Rein

[57] ABSTRACT

This invention relates to a ground actuated lid operating system including (1) a pressure release lid apparatus operable to selectively open and close a pressure lid member to release fluid pressure from the interior of a silo structure; and (2) an entrance lid closure apparatus operable to open and close a closure lid member without leaving the area of the support surface adjacent the silo structure. The pressure release lid apparatus has the pressure lid member biased to a closed positive seal condition and opened through the use of a lid actuator assembly and lid linkage assembly which is operable from a position adjacent to a side wall of the silo structure not requiring the climbing thereof. The entrance lid closure apparatus is provided with an axially movable closure lid member which is movable from the open condition to add granular materials to the silo structure and laterally and subsequently downwardly to a positive sealed position about a silo entrance opening. The pressure release lid apparatus and the entrance lid closure apparatus are operable from a ground surface adjacent to a silo structure not requiring the climbing thereof which is a time, labor, saving function plus providing safety features.

11 Claims, 6 Drawing Figures

FIG. 2
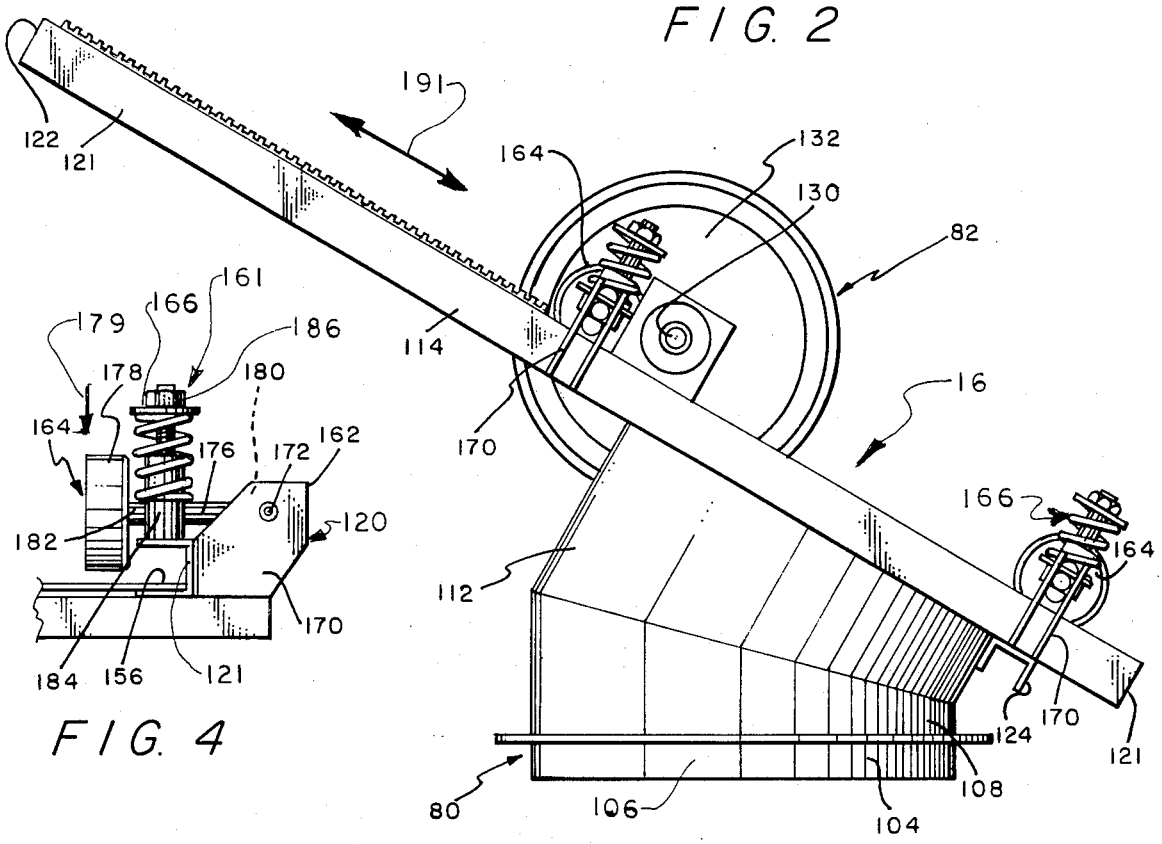
FIG. 4
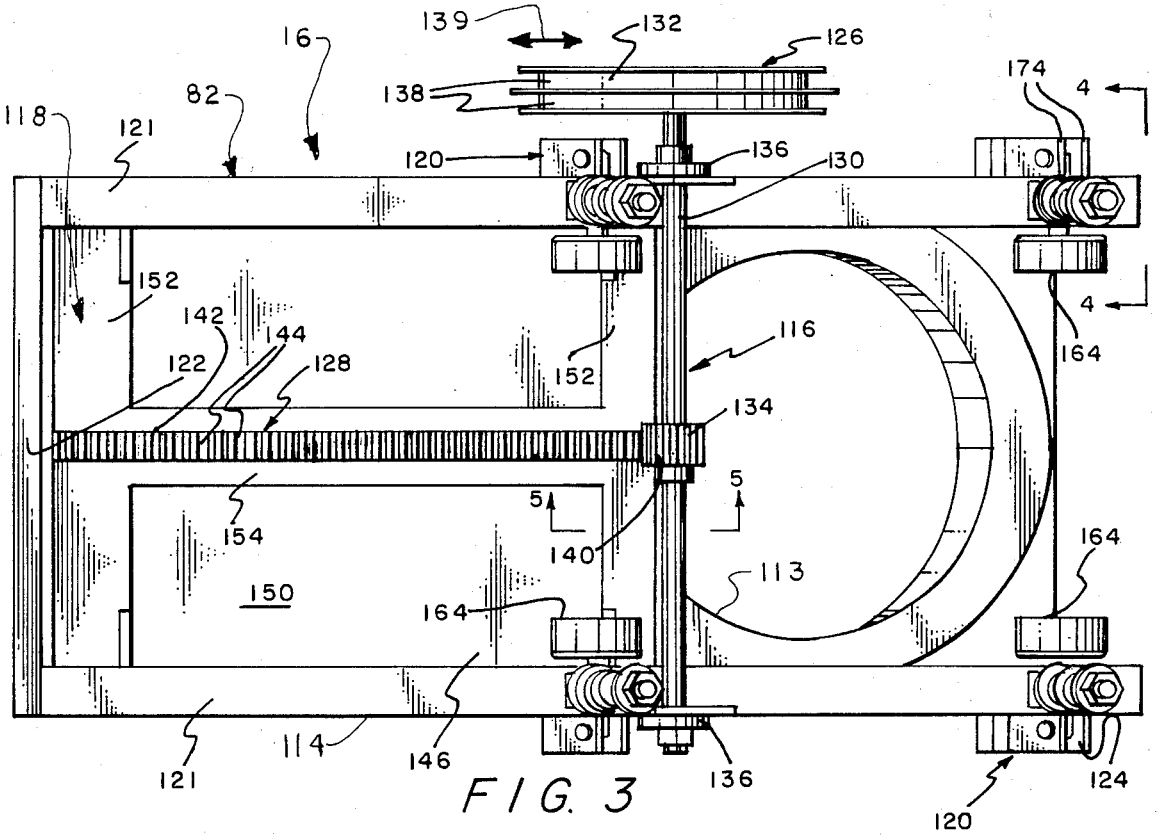
FIG. 3

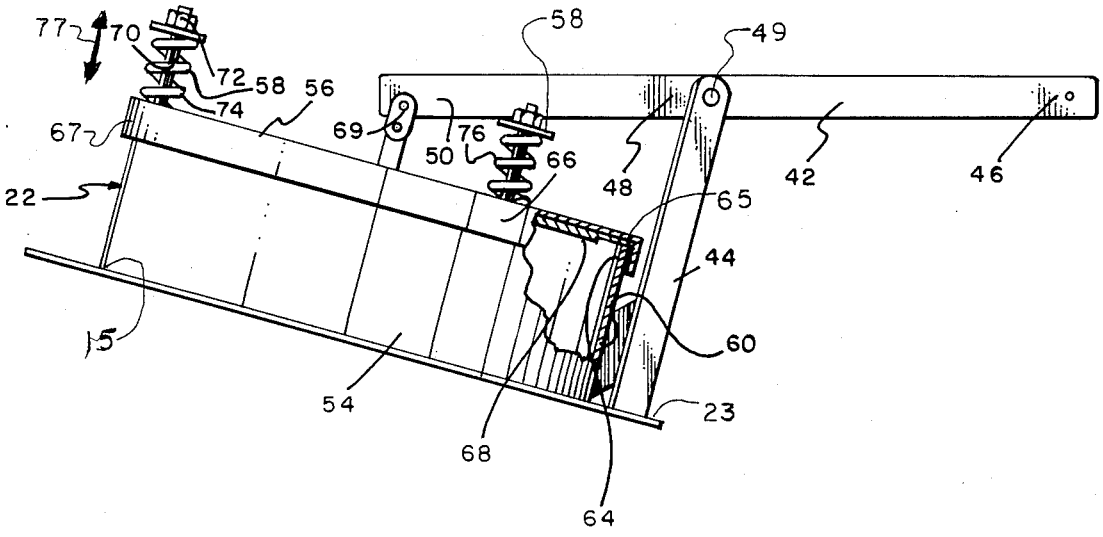
FIG. 6
FIG. 5
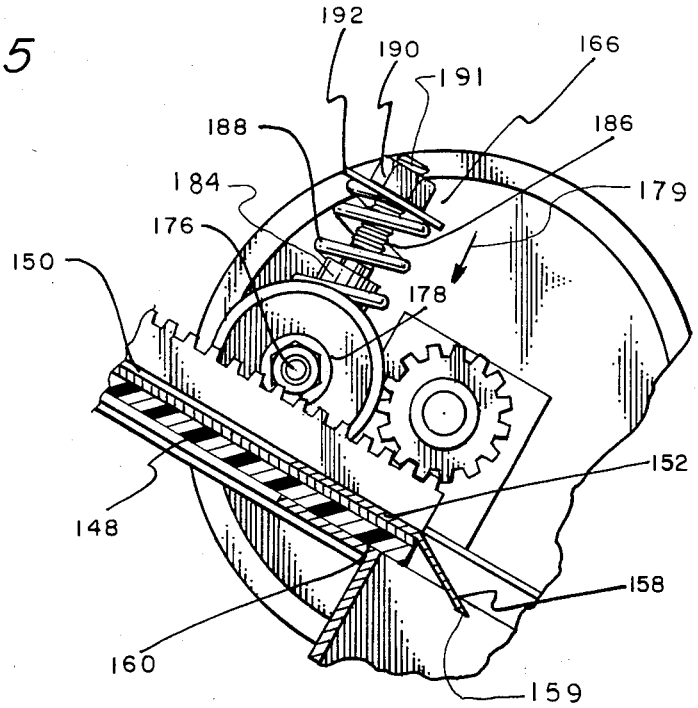

GROUND ACTUATED LID OPERATING SYSTEM

PRIOR ART

A patentability investigation was conducted on the subject invention and the following United States Patents are noted:

U.S. Pat. No. 431,926, CAR DOOR;

U.S. Pat. No. 701,156, APPARATUS FOR CLOSING OR OPENING WATER TIGHT BULKHEAD DOORS;

U.S. Pat. No. 853,765, OPERATING BULKHEAD DOORS;

U.S. Pat. No. 1,591,497, DOOR AND OPERATING MEANS THEREFOR;

U.S. Pat. No. 1,796,168, COVER FOR STORAGE BINS.

The Stair patent discloses a closure member for storage bins which is operable through a cable from a ground surface in order to open and close a lid structure. The Stair lid structure is movable on rollers and closed by the force of gravity but does not achieve the positive sealing function of the applicant's invention as set forth hereinafter.

The Buck and Crawford patents disclose rack and pinion structures for closing doors such as found on ocean going ships where positive seal is, of course, very important. However, other than utilizing the rack and pinion structures, these references are not pertinent to the applicant's invention.

The Reeves patent discloses a rack and pinion utilized on a vertical grain door structure. The Walker patent discloses the use of a central rack and pinion in order to open and close car doors such as found on the side of railroad train cars and the like. These patents do not have the other new and novel features of the applicant's invention as set forth hereinafter.

PREFERRED EMBODIMENTS OF THE INVENTION

The one preferred embodiment of this invention, a ground actuated lid operating system, is provided which can be readily attached to a silo structure and operable to (1) release gaseous pressure from the interior of the silo structure so that granular material can be added thereto; and (2) gain access to an entrance opening on the top of the silo structure in order to add the granular material therethrough the subject entrance opening. The ground actuated lid operating system includes (1) a pressure release lid apparatus; and (2) an entrance lid closure apparatus. The pressure release lid apparatus is provided with a lid actuator assembly positioned near a support ground surface and connected through a lid linkage assembly to a pressure lid assembly. The pressure lid assembly is provided with a pressure lid member which is held by biasing members in the closed, sealed condition. The lid actuator assembly is provided with a lock handle assembly which is operable through the use of the lid linkage assembly to open and close the pressure lid assembly to release gaseous pressure from the interior of the silo structure. The entrance lid closure apparatus includes a closure actuator assembly connected to the silo structure adjacent to the ground surface and operably connected to an entrance closure assembly mounted on a closure mount assembly. The entrance closure assembly includes a closure support assembly having a lid actuator assembly mounted thereon and a closure lid assembly movable by the lid actuator assembly relative to the closure support assembly. The closure lid assembly is provided with a closure lid member operable to enclose an entrance opening in a sealed manner and being movable laterally of the opening through the closure actuator assembly so as to gain access thereto. The lid actuator assembly is operable to achieve a lateral movement of the closure lid member to conjointly move the same laterally and dowwardly to obtain a positive seal on the closure mount assembly which is necessary to achieve the positive seal and prevent the flow of moist air and other gaseous fluid to the interior of the silo structure.

OBJECTS OF THE INVENTION

One object of this invention is to provide a ground actuated lid operating system operable to achieve the functions of (1) release gaseous pressure from the interior of the silo structure; and (2) to open a closure lid member about an upper entrance opening with the operator standing on the ground surface so that a conveyor system can be used to move granular material such as wheat, milo, and the like, upwardly through the upper entrance opening and into the interior of the silo structure.

One other object of this invention is to provide a ground actuated lid operating system having a pressure release lid apparatus which is adapted to be operated by the operator standing on a ground surface next to a silo structure in order to move a pressure lid member upwardly from its adjacent opening to release the gaseous fluid material therefrom which is necessary on filling the silo structure to remove the air pressure therefrom and allow the granular material to completely fill the silo structure.

One further object of this invention is to provide a ground actuated lid operating system including an entrance lid closure apparatus having a closure actuator assembly connected to the silo structure adjacent to the ground surface and connected through an actuator cable assembly to an entrance closure assembly having a closure lid member which is operable to be moved from an open position to a positively sealed closed position by the operator standing on the ground surface next to the silo structure.

One other object of this invention is to provide a ground actuated lid operating system having a pressure release lid apparatus to relieve pressure from within a silo structure and an entrance lid closure apparatus operable to gain entrance at the top portion of the silo structure to add granular material, both of such lid appartus structures being operable by an operator standing on the ground surface next to the silo structure thus providing numerous safety features to the operator.

Still, another object of this invention is to provide a ground actuated lid operating system which is readily installed on existing silo structure; having an adapter ring assembly so to be readily mountable on various types of silo structures with different size of entrance openings thereto; economical to manufacture; sturdy in construction; and substantially maintenance free.

Various other objects, advantages, and features of the invention will become apparent to those skilled in the art from the following discussion, taken in conjunction with the accompanying drawings, in which:

FIG. 2 is a side elevational view of a portion of an entrance lid closure apparatus of the ground operated lid operating system of this invention;

FIG. 3 is a top plan view of the portion of the entrance lid closure apparatus illustrated in FIG. 2;

FIG. 4 is an enlarged fragmentary sectional view taken along line 4—4 in FIG. 3;

FIG. 5 is an enlarged fragmentary sectional view taken along line 5—5 in FIG. 3; and FIG. 6 is a fragmentary side elevational view of a pressure release lid apparatus of this invention as mounted on the silo structure and having portions thereof broken away for clarity.

Figure 1:
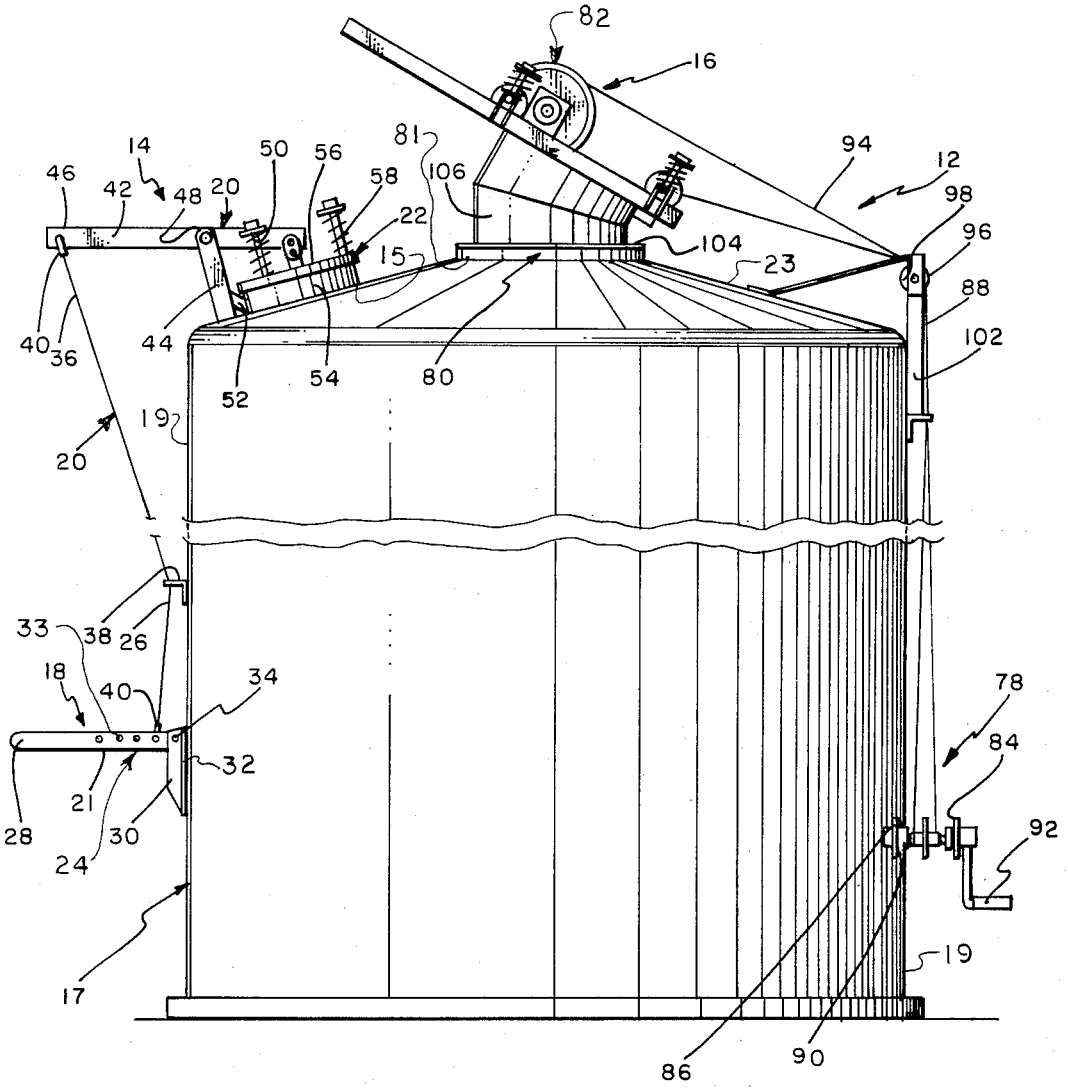
FIG. 1 is a side elevational view of a silo structure having a ground actuated lid operating system of this invention connected thereto.

The following is a discussion and description of preferred specific embodiments of the new ground actuated lid operating system of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular FIG. 1, a ground actuated lid operating system of this invention, indicated generally at 12, includes a pressure release lid apparatus 14 and an entrance lid closure apparatus 16 which are both mounted on the exterior of a grain storage or silo structure 17. The silo structure 17 is adapted to be supported on a ground surface and, in many cases, may be a very tall structure which necessitates the climbing of an exterior metal ladder to the top thereof to open and close the lid structures thereon to (1) release fluid pressure from the interior thereof in order to add granular material to the silo structure 17; and (2) opening of a lid structure so as to use an auger conveyor or the like to transport granular material upwardly to be discharged into an opening into the silo structure 17. This opening and closing of lid structures on the top of the silo structure 17 is, of course, a very dangerous operation and, particularly, in extremely cold and hot weather due to the normal metal nature of the silo structures 17. Therefore, this invention is safety related as it achieves the opening and closing of the lid structures on the top of the silo structure 17 by an operator on standing on the ground surface next to the subject silo structure 17 as will be explained.

As shown in FIGS. 1 and 6, the pressure release lid apparatus 14 is adapted to be placed about an opening 15 which is used to release air and/or gaseous pressure from the interior of the silo structure 17 which is necessary when adding a granular material such as grain, milo, oats, etc., thereto. The pressure release lid apparatus 14 includes (1) a lid actuator assembly 18 connected to a side wall 19 of the silo structure 17; (2) a lid linkage assembly 20 mounted on a top surface of the silo structure 17 and connected to the lid actuator assembly 18; and (3) a pressure lid assembly 22 mounted on an inclined upper surface 23 of the silo structure 17 and operably connected to the lid linkage assembly 20. The lid actuator assembly 18 includes a lock handle assembly 24 connected to the side wall 19 and interconnected through a cable connector 26 to the lid linkage assembly 20.

The lock handle assembly 24 includes a lock handle member 28 pivotally through adjacent parallel connector angles 30 by a lock pin assembly 32. The lock handle member 28 is provided with a plurality of holes 33 so as to provide a locking feature with a bolt member 34 plus adjustment features. Also, a padlock member could be inserted through the holes 33, the lock handle 28, and the connector angles 30 to prevent unauthorized operation of the lock handle assembly 24.

The cable connector assembly 26 includes an elongated cable member 36; a cable guide member 38 secured through the side wall 19 and adapted to receive the cable member 36 therethrough; and an adjustable cable connector 40 attached to each opposite end of the cable member 36. The cable member 36 has a lower end thereof attached through one of the holes 33 and the handle member 28 and therefore can be moved and adjustably mounted in any one thereof to obtain the desired adjustment in overall length as required for the cable member 36. The adjustable cable connectors 40 can be of a turnbuckle type or the like to provide an additional adjustable feature. The cable guide member 38 can have an eyelet therein to receive the cable member 36 therethrough. The outer end of the upper one of the adjustable cable connectors 40 is interconnected to the lid linkage assembly 20.

As noted in FIG. 6, the lid linkage assemble 20 includes a link arm member 42 pivotally connected at a central portion thereof to an arm support member 44. The link arm member 42 includes an outer arm section 46 to receive the cable member 36 thereon; a central arm section 48 which is pivotally connected as by a bolt member 49 to the arm support member 44; and an inner arm section 50 which is pivotally connected to the pressure lid assembly 22.

The pressure lid assembly 22 includes (1) a main support base 54 adapted to be placed about the silo entrance opening 15; (2) a pressure lid member 56 mounted on the main support base 54; and (3) a plurality of lid biasing members 58 interconnected between the pressure lid member 56 and the main support base 54 to bias the pressure lid member 56 into a sealed, closed condition.

The main support base 54 includes a cylindrical rim member 60 mounted about the entrance opening 15 and secured thereto as by welding or adapter ring or the like. The cylindrical ring member 60 has an upper edge section 64 with an upper surface 65 which is adapted to create a seal with the pressure lid member 56 to prevent air and gaseous fluid from escaping from the interior of the silo structure 17 in a manner to be explained.

The pressure lid member 56 includes a main lid body 66 having a seal member 68 on a lower surface thereof which is adapted to seal in a closed condition with the upper surface 65. The main lid body 66 is provided with an outer flange section 67 adapted to enclose about the upper end section 64 of the main support base 54 to prevent rain and the like from entering the silo structure 17. The pressure lid member 56 further includes a pivotal link connector 69 which interconnects the link arm member 42 with the pressure lid member 56 so as to move the subject lid member 56 vertically against the lid biasing members 58 in a manner to be explained.

The plurality of lid biasing members 58 includes separate units of three (3), each including a main upright support bolt 70 having a lower end interconnected to an innersurface of the main support base 54; a nut and washer member 72 connected to an upper end of each of the support bolts 70; and biasing members 74 mounted between a lower surface of the nut and washer member 72 and an upper surface of the main lid body 66 of the pressure lid member 56. The biasing members 74 are composed of compression spring members 76 which obviously resist movement of the pressure lid member 56 upwardly in a direction as indicated by an arrow 77.

On referring to the entrance lid closure apparatus 16 as best illustrated in FIGS. 2 and 3, the entrance lid closure apparatus 16 includes (1) a closure actuator assembly 78 connected to the side wall 19 of the silo structure 17; (2) a closure mount assembly 80 connected into the upper inclined upper surface 23 of the silo structure 17 about a fill opening 81; and (3) an entrance closure assembly 82 mounted on the closure mount assembly 80 and operable in having a lid member portion to be opened and closed by operation through the closure actuator assembly 78.

The closure actuator assembly 78 includes (1) a winch assembly 84 secured to the side wall 19 of the silo structure 17; (2) a lock assembly 86 operable to secure the winch assembly 84 in a desired condition; and (3) an actuator cable assembly 88 interconnected between the winch assembly 84 and the entrance closure assembly 82 in a manner to be described.

The winch assembly 84 includes a rotatable winch member 90 which is operable through a winch handle member 92 to wind and unwind a portion of the actuator cable assembly 88 thereon. The winch member 90 can be of a conventional rachet type structure but being such so as to rotate positively in opposite directions so as to achieve a positive opening and closing of the lid member portion of the entrance closure assembly 82 in a manner to be explained.

The lock assembly 86 can be of various types such as a snap member or a padlock structure so that the locking of the winch member 90 prevents unauthorized operation of the entrance closure assembly 82 which is very important on maintaining a positive, sealed condition within the silo structure 17.

The actuator cable assembly 88 includes an actuator cable member 94 having (1) a lower end connected to the winch assembly 84 and a mid-portion thereof trained over an intermediate pulley assembly 96 with an upper end thereof connected to the entrance closure assembly 82. The actuator cable member 94 can be of a multi-strand steel construction and being preferrably of the type thereof that would not stretch so as to achieve a positive movement of the entrance closure assembly 82 on being wound about a portion of the winch member 90 of the winch assembly 84.

The intermediate pulley assembly 96 includes a rotatable pulley member 98 mounted on an upper end of a support bracket 102 which, in turn, is secured to the side wall 19 of the silo structure 17 and an upper portion thereof. The pulley member 98 is adapted to receive a portion of the actuator cable member 94 in an outer groove thereof so as to train the same thereabout and direct upwardly to the entrance closure assembly 82.

As noted in FIG. 2, the closure mount assembly 80 includes an adapter ring assembly 104 adapted to surround the fill opening 81 into the silo structure 17. The adapter ring assembly 104 can be constructed of various sizes, diameters, and depths so as to allow for mounting of the entrance closure assembly 82 thereon regardless of the size and configuration of the normally circular fill opening 81.

The adapter ring assembly 104 is provided with a main connector tube member 106 having an anchor section 108 adapted to fit within the fill opening 81 and integral with an upper inclined portion 112. The upper inclined portion 112 is adapted to present an upper opening 113 which can be opened and closed by the entrance closure assembly 82 in a manner to be described.

The entrance closure assembly 82 includes (1) a closure support assembly 114 mounted on the closure mount assembly 80; (2) a lid actuator assembly 116 supported on a portion of the closure support assembly 114; (3) a closure lid assembly 118 mounted on the closure support assembly 114 operable to open and close entrance through the upper opening 113; and (4) a closure biasing assembly 120 operably connected between the closure support assembly 114 and the closure lid assembly 118 to hold the lid portion in a closed sealed condition as will be explained.

The closure support assembly 114 includes a pair of spaced parallel u-shaped support channels 121 interconnected at outer ends to end connector channels 122, 124. The support channels 121, as noted in FIG. 4, are of u-shaped in transvere cross-section and face inwardly toward each other to provide support to the closure lid assembly 118 and the closure biasing assemblies 120 as will be explained. A lower surface of the support channels 121 are secured as by welding to the upper portion of the adapter ring assembly 104. The end connector channels 122, 124 are operable to provide rigidity to the support channels 121 and, additionally, they provide stop members for movement of the closure lid assembly 118 as will be noted.

The lid actuator assembly 116 includes (1) an actuator pinion assembly 126 connected to the closure assembly 114 and operable through the closure actuator assembly 78; and (2) an actuator rack assembly 128 operably connected to the actuator pinion assembly 126 and to the closure lid assembly 118.

The actuator pinion assembly 126 includes (1) a driven shaft member 130 rotatably connected to the support channels 121 of the closure support assembly 114; (2) a driven pulley member 132 mounted on an outer end of a driven shaft member 130; and (3) a pinion member 134 connected to a central portion of the driven shaft member 130. The driven shaft member 130 has its outer ends thereof rotatably mounted in bearing members 136.

The driven pulley member 132 is of a conventional nature provided with dual cable sections 138 to receive portions of the actuator cable member 94 therein. The dual sections 138 with respective portions of the cable member 94 are operable to achieve a positive movement of the driven pulley member 132 in opposite directions as noted by the arrow 139 to achieve a positive operation of the closure lid assembly 118 to opened and closed positions as will be explained.

The pinion member 134 is provided with an outer pinion tooth section 140 which is of a conventional pinion nature and operable to engage the actuator rack assembly 128 as will be explained.

The actuator rack assembly 128 includes an elongated rack bar member 142 having tooth sections 144 which are engagable with with the pinion tooth sections 140. It is obvious that the rotation of the driven pulley member 132 on the driven shaft member 130 in turn rotates the pinion member 134 which will then axially move the rack bar member 142 due to the engagement with the rack tooth sections 144. Of course, axial movement of the rack bar member 142 operates to move the closure lid assembly 118 as will be noted.

The closure lid assembly 118 includes a closure lid member 146 having (1) a main body member 150; (2) end clamped plates 152 mounted on the top surface and at opposite ends of the main body member 150; and (3) a central rack support section 154 secured to the top surface of the main body member 150 and having the rack bar member 142 anchored to a top surface thereof.

The main body member 150 is provided with outer support edges 156 which are respectively mounted in and supported on the u-shaped support channels 121 as noted in FIG. 4.

The end clamp plates 152 are provided with outer inclined end sections 158 with an outer tipped portion 159 which are important in the positive sealing action of the closure lid member 146 when moved to the closed, sealed condition.

The central rack support section 154 provides rigidity to the main body member 150 and to the support of the rack bar member 142.

The closure lid member 146 includes a closure seal member 148 mounted on a bottom surface thereof.

The closure seal member 148 as noted in FIG. 5 extends across the lower bottom area and secured to the main body member 150 of the closure lid member 146. The closure seal member 148 includes a rubber seal 160 which is adapted to contact and seal with the upper edge about the upper opening 113 of the adapter ring assembly 104 to achieve a positive seal therewith in a closed condition to maintain pressure within the silo structure 17.

As noted in FIGS. 4 and 5, the closure biasing assembly 120 includes a plurality of closure assemblies 161, namely, four (4) thereof, each including (1) a support bracket member 162 operably connected to outer spaced portions of the support channels 121; (2) a bias wheel assembly 164 pivotally connected to the respective support bracket members 162; and (3) a bias load assembly 166 to bias the respective wheel assemblies 164 towards engagement with the closure lid member 146 in a manner to be explained.

Each support bracket member 162 includes a support bracket 170 having a hole therein with a pivot pin 172 mounted therein. Each support bracket 170 is provided with adjacent space parallel support plates 174.

Each bias wheel assembly 164 includes a support shaft 176 having one end pivotally mounted on the respective pivot pin 172 and a rotatable wheel member 178 mounted on the other outer end thereof. The support shaft 176 is provided with a connector section 180 pivotally connected to the pivot pin 172 and an other opposite end having a wheel section 182 on which the rotatable wheel member 178 is mounted. The respective wheel members 178 are biased downwardly in the direction as indicated by arrow 179 into engagement with the closure lid member 146 as will be explained.

Each bias load assembly 166 includes (1) a connector housing 184 secured to a top surface of the support channels 121 as noted in FIG. 4; (2) an upright connector pin 186 secured to a top surface of the connector housing 184; and (3) a spring member 188 operably mounted between the connector pin 186 and a top surface of the support shaft 176 of the bias wheel assembly 164 to urge the same downwardly in a direction as indicated by the arrow 179.

The connector pin 186 includes a nut and washer member 190 mounted on a bolt member 191 and having a washer member 192 to receive the upper portion of the spring member 188 thereagainst.

It is seen that the nut and washer member 190 is adjustable on the bolt member 191 so as adjust the spring pressure against the support shaft 176 of the wheel assembly 164. Therefore the amount of pressure urging the wheel member 178 downwardly as indicated by the arrow 179 is readily adjustable on rotation of the nut and washer member 190 to compress or relax the compression of the spring member 188.

USE AND OPERATION OF THE INVENTION

In the use and operation of the ground actuated lid operating system 12 of this invention, it is attached to a silo structure 17 in order to operate lid structures on the top surface thereof with the operator standing next to the silo structure 17 and not being required to climb to the top thereof to effectuate such lid openings.

The pressure release lid apparatus 14 as noted in FIG. 1 is attached to the side wall 19 as the lock handle assembly 24 is secured thereto. The cable member 36 is attached to the lock handle assembly 24 and trained upwardly through the cable guide member 38 to be attached to the lid linkage assembly 20. The lid linkage assembly 20 has a link arm member 42 pivotally connected to the arm support member 44 which is anchored to the inclined upper surface 23 of the silo structure 17. The inner arm section 50 of the link arm member 42 is pivotally connected to the link connector 69 to selectively open and close the pressure lid member 56. It is obvious that the three (3) spaced lid biasing members 58 are operable through the compression spring members 76 to bias the main lid body 66 to the closed condition. The seal member 68 is adapted to contact the upper edge section 64 of the main support base 54 to provide a positive fluid pressure tight seal therewith in the closed condition.

The lock handle assembly 24 is operable to be locked in the open condition and secured thereto with a lock pin assembly 32 if so desired when filling the silo structure 17 through the upper opening 113 of the entrance lid closure assembly 16. The opening of the pressure release lid apparatus 14 is required during a filling operation of granular material into the silo structure 17 to allow the air and gas to escape therefrom so that the granular material may fill this area without air pockets and, thus, wasted storage space being formed within the silo structure 17 during the granular filling operation.

The entrance lid closure apparatus 16 is operable by attaching the closure acuator assembly 78 to the side wall 19 of the silo structure 17 as noted in FIG. 1. More particularly, the winch assembly 84 is secured to the sidewall 19 and the actuator cable member 94 is trained upwardly about the intermediate pulley assembly 96 and attached to the entrance closure assembly 82. The winch assembly 84 is provided with a lock assembly 86 which is operable to lock the entrance closure assembly 82 in the opened or closed condition as so desired and prevent unauthorized operation thereof. The lock assembly 86 is necessary so that it is assured that the entrance closure assembly is locked in the closed condition to prevent atmospheric air with moisture from entering the interior of the silo structure 17 which could cause deterioration of the granular material stored therein.

The closure mount assembly 80 is provided with various sizes of adapter ring assemblies 104 so as to be mounted about various sizes of upper openings 113 which is utilized to receive the granular material into the silo structure 17.

The entrance closure assembly 82 has the closure support assembly 114 with the parallel support channels 121 secured to an upper surface of the inclined portion 112 of the adapter ring assembly 104. The parallel space support channels 121 are adapted to receive the closure lid assembly 118 therein for sliding movement as indicated by an arrow 191 in FIG. 2.

The actuator pinion assembly 126 includes the shaft member 130 having the driven pulley member 132 on an outer end thereof having the upper end portions of the actuator cable member 94 attached thereto. The upper ends of the cable member 94 are secured to respective sides of the dual section 138 of the driven pulley member 132 to achieve a positive rotation of the driven pulley member 132 on rotation of the winch handle member 92 of the winch assembly 84. This positive operation of the winch assembly 84 achieves a positive movement of the closure lid assembly 118 as shown by the arrow 191 in FIG. 2 and, therefore, does not rely on the force of gravity but positive movement of the closure lid member 146.

It is noted that the closure biasing assembly 120 with the wheel members 178 being biased to a downward direction as noted by arrow 179 provides a positive downward force against the top surface of the closure lid member 146 which is adapted to contact the end clamped plates 152 on first being engaged by the inclined end sections 158.

On movement of the closure lid member 146 from the open condition which is the highest elevated position within the support channels 121, the winch handle member 92 is rotated which, in turn, rotates the driven pulley member 132 as interconnected by the actuator cable member 94. This causes the interconnection of the pinion tooth sections 140 and the rack tooth sections 144 so as to start movement of the closure lid movement 146 in the downward direction as indicated by the arrow 191. On subsequent movement, the wheel members 178 initially contact the inclined end sections 158 of the end clamped plate 152. On initial contact, this achieves an initial downward forced movement of the main body member 150 which then moves the closure seal member 148 downwardly into contact with the upper surface of the outer inclined portion 112 of the connector tube member 106. This downward movement allows the seal member 148 to move vertically into contact with the upper surface of the outer inlined portion 112 to achieve a positive sealing therewith and prevent undue and unnecessary wear between these contacting parts while achieving a positive sealing action.

The inclined portion of the end sections 158 with the respective wheel members 178 achieve this positive downward movement and positive sealing function which is necessary for long wear of the closure seal member 148 and positive pressure sealing of the entire closure lid assemly 118.

It is seen that the closure biasing assemblies 120 are individually adjustable through the use of the nut and washer members 190 to increase or decrease the action of the spring members 188 to achieve the desired biasing force through the wheel members 178; the end clamp plates 152; and to the closure lid member 146.

It is seen that the positive operation through the use of the driven pulley member 132 and the actuator cable member 94 also achieves a positive initial upward movement of the closure lid member 146 when moving from the closed condition to the open condition for then subsequent movement upwardly as shown by the arrow 191 towards the upper end connector channel 122 into the open condition so that granular material can be added through the opening 113 in a conventional manner as through auger conveyors or the like.

It is seen that the ground actuated lid operating system of this invention is readily attachable to new or existing silo structures in the field and can be attached by the silo owner not requiring special tools and skills to do so. The ground actuated lid operating system of this invention provides for access to a pressure release opening and a granular material fill opening without requiring the operator to climb to the top of the silo structure which has proven to be a very dangerous operation especially under icy or extreme heat conditions. The ground actuated lid operating system of this invention is simple in operation, sturdy in construction, and substantially maintenance free.

While this invention has been described in conjunction with preferred specific embodiments thereof, it will be understood that this description is intended to illustrate and not limit the scope of the invention, which is defined by the following claims.

I claim:

1. A ground actuated lid operating system connected to a upright silo structure operable to be connected to access openings thereto, comprising:

(a) a pressure release lid apparatus including a lid actuator assembly secured to a side wall of the silo structure; a pressure lid assembly secured to an upper portion of the silo structure; and a lid linkage assembly connected to the silo structure and operably connected to the pressure lid assembly;

(b) said lid actuator assembly includes a lock handle assembly connected to a cable connector assembly and to a cable member to open and close a portion of said pressure lid assembly; and (c) said pressure lid assembly including a pressure lid member mounted about one of the access openings into the silo structure and having a lid biasing member to bias said pressure lid member to a closed condition;

whereby said lid actuator assembly is operable through said cable member to open and close said pressure lid member to allow pressure within the silo structure to escape therefrom and being biased into a closed condition by said lid biasing member.

2. A pressure release lid apparatus as described in claim 1, wherein:

(a) said lock handle assembly pivotablly connected to a connector members so as to be rotatable to move said cable member to move said pressure lid member from the closed to open positions operable from a position adjacent a lower surface of the silo structure.

3. A pressure release lid apparatus as described in claim 1, wherein:

(a) said lid linkage assembly includes a link arm member pivotal on a arm support member having one end connected to said cable member and the oppositie end pivotally connected to said pressure lid assembly whereby said cable member is movable by said lock handle assembly to pivot said link arm member which, in turn, raises said pressure lid member to the opened condition to release fluid pressure from the silo structure.

4. A pressure release lid apparatus as described in claim 1, wherein:

(a) said pressure lid assembly includes a main support base secured to the silo structure; said pressure lid member mounted on an upper edge section of said main support base to form a seal therewith; and said lid biasing members connected to said main support base and operably connected to said pressure lid member to bias said pressure lid member to the sealed, closed condition.

5. A ground actuated lid operating system to selectively open and close an opening at an upper portion of an elevated structure from a ground surface, comprising:

(a) an entrance lid closure apparatus including a closure actuator assembly secured to a lower portion of the elevated structure and an entrance closure assembly connected to the upper portion of the elevated structure and mounted about the opening therein;

(b) said entrance closure assembly including a closure support assembly secured about the opening in the elevated structure and a pressure lid member reciprocately mounted in said closure support assembly to selectively expose and cover the opening; and (c) said closure actuator assembly includes a winch assembly secured to a lower portion of the elevated structure and an actuator cable assembly connected to said winch assembly and said pressure lid member;

whereby said actuator cable assembly is operable to move said pressure lid member relative to the opening and downwardly, when above the opening, to the closed, sealed condition.

6. A ground actuated lid operating system as described in claim 5, wherein:

(a) said actuator cable assembly includes an intermediate pulley assembly connected to the upper portion of the elevated structure and a cable member trained about said intermediate pulley assembly; and (b) an upper outer end of said cable member secured to said pressure lid member.

7. A ground actuated lid operating system as described in claim 5, including:

(a) a closure mount assembly mounted about the opening and having said entrance closure assembly secured thereto;

(b) said closure mount assembly having an outer inclosed portion with a top surface to be sealed with said pressure lid member; and (c) said pressure lid member having a seal member to engage said top surface of said pressure lid member in the closed condition to achieve a pressure seal therewith.

8. A ground actuated lid operating system as described in claim 7, wherein:

(a) said pressure lid member first movable longitudinally on said closure support assembly from open to closed positions and then downwardly to engage said seal member with said top surface to form a pressure seal in the closed condition.

9. A ground actuated lid operating system as described in claim 8, wherein:

(a) said entrance closure assembly incudes a closure biasing assembly engagable with said pressure lid member when over the opening to bias same into sealing engagement with said top surface in the closed condition.

10. A ground actuated lid operating system as described in claim 7, wherein:

(a) said entrance closure assembly includes a lid actuator assembly having an actuator rack assembly secured to a top surface of said pressure lid member, and an actuator pinion assembly connected to said closure actuator assembly; and (b) said closure actuator assembly operable to rotate said actuator pinion assembly to engage said actuator rack assembly to reciprocate said pressure lid member between opened and closed positions.

11. A ground actuated lid operating system as described in claim 10, wherein:

(a) said pressure lid member having end clamp plates engagable with said bias wheel assembly to move same vertically when over said opening to the closed, biased, sealed condition.

* * * * *